United States Patent [19]

Kirby

[11] 4,449,465

[45] May 22, 1984

[54] UNIVERSAL STITCHING GUIDE

[76] Inventor: Dorothy Y. Kirby, 633 Linden St., Clermont, Fla. 32711

[21] Appl. No.: 419,021

[22] Filed: Sep. 16, 1982

[51] Int. Cl.[3] ..... D05B 55/06

[52] U.S. Cl. ..... 112/153; 33/DIG. 1; 248/205.3

[58] Field of Search ..... 428/900; 112/153; 248/205.3, 206.5; 211/DIG. 1; 33/DIG. 1, 179, 177, 176

[56] References Cited

U.S. PATENT DOCUMENTS

| | | | |
|---|---|---|---|
| 3,023,991 | 3/1962 | Fisher | 248/205.3 |
| 3,169,743 | 2/1965 | Page, Jr. | 248/205.3 |
| 3,189,981 | 6/1965 | Genin et al. | 428/900 X |
| 3,228,365 | 1/1966 | Yoshida | 112/153 |
| 3,239,178 | 3/1966 | Pompa | 248/205.3 |
| 3,256,442 | 6/1966 | Sedlar | 428/900 X |
| 3,263,634 | 8/1966 | Gross | 112/153 |
| 3,401,658 | 9/1968 | Kirby | 112/153 |
| 3,924,212 | 12/1975 | Brown | 428/900 X |
| 4,291,467 | 9/1981 | Shultz, Jr. | 33/DIG. 1 X |

*Primary Examiner*—Werner H. Schroeder
*Assistant Examiner*—Andrew M. Falik
*Attorney, Agent, or Firm*—Duckworth, Allen, Dyer & Pettis

[57] ABSTRACT

A universal stitching and seam guide attachable to any sewing machine for permitting the operator to produce straight or curved stitchings, and even and uniform seams and hems. A thin steel mounting plate having a pressure sensitive adhesive on its bottom surface is provided for installation on a sewing machine bed plate adjacent the needle plate and presser foot. A guide plate is provided formed from magnetized rubber-like material and having straight sides and curved sides. The guide plate is placed on the mounting plate and is held in place by magnetism. The appropriate edge is selectively positioned for the type of stitching being performed. The guide plate will also adhere to the needle plate on the machine when a narrow tuck, edge stitching or seam is to be made.

6 Claims, 6 Drawing Figures

UNIVERSAL STITCHING GUIDE

BACKGROUND OF THE INVENTION

1. Field of the Invention

The present invention relates to a seam and stitching guide for sewing machines and more particularly to an improved guide that is universally attachable to any sewing machine.

2. Description of the Prior Art

In my U.S. Pat. No. 3,401,658, I disclose a seam and stitching guide formed from an integral flat plate of aluminum or similar metal. The guide includes a long straight edge, a convexly curved edge, a concavely curved edge, a short straight edge, and a pointed portion. The flat plate has an elongate slot for fastening the guide to the bed plate of a sewing machine by means of a set screw installed in the tapped hole provided in the bed plate of many older style sewing machines for mounting of attachments. The slot permits a wide range of adjustment of the guide to place a desired one of the several edge shapes adjacent to the presser foot of the machine to produce the required stitching width. This guide has been widely used by thousands of persons since its availability.

Unfortunately, most modern sewing machines do not have a tapped hole in the bed plate for securing of attachments since these are mounted by replacing the presser foot or the attachment function is provided by the machine head. Thus, the seam guide of my U.S. Pat. No. 3,401,658 patent cannot be used with such newer machines.

SUMMARY OF THE INVENTION

My invention is an improvement on the stitching and seam guide described in the U.S. Pat. No. 3,401,658 patent which permits the improved guide to be attached to any sewing machine. Additionally, the improved guide may be adjusted to a wider range of positions than my earlier device.

My improved stitching guide includes a thin steel mounting plate which may be square or rectangular. The mounting plate has a back surface coated with a pressure sensitive adhesive material which permits the mounting plate to be mounted on the bed plate of a sewing machine adjacent to the needle plate. The edges of the mounting plate are chamfered to prevent catching or snagging of material being stitched. The guide plate is preferably of the same shape as my earlier seam guide but is formed from a magnetized rubber-like material of the type available from the B. F. Goodrich Company under the trade name of "Koroseal". The material is magnetized such that the entire surface is attracted to a steel surface.

After the mounting plate is installed on a machine bed plate, the magnetized guide plate is placed upon the surface thereof and is manually adjusted to bring the desired guide edge adjacent the machine presser foot. When an edge is required to be close to the presser foot, the magnetized guide plate may also contact and grip the needle plate which is commonly chromium plated steel.

It is therefore a principal object of my invention to provide an improved seam and stitching guide which is universally installable on any sewing machine.

It is another object of my invention to provide an improved stitching guide which is held securely in a desired position by magnetism.

It is yet another object of my invention to provide a stitching guide having a very wide adjustment range.

It is still another object of my invention to provide a stitching guide magnetically attachable to a sewing machine which permits the user to stitch a preselected distance from a given edge of material being sewed.

It is a further object of my invention to provide a thin steel plate for attaching adhesively to the bed plate of any sewing machine for permitting a magnetic seam guide to be placed thereon.

These and other objects and advantages of my invention will become apparent from the following detailed description when read in conjunction with the drawings.

DETAILED DESCRIPTION OF THE PREFERRED EMBODIMENT

Figure 1:
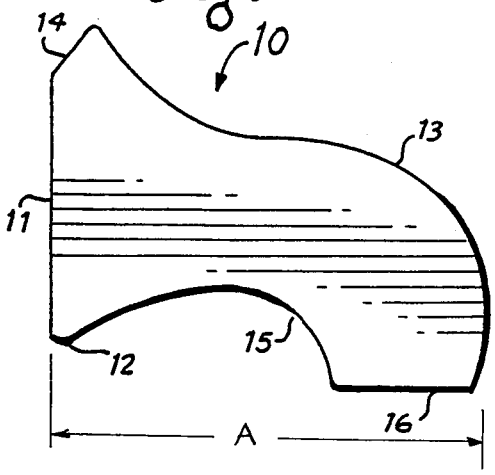
FIG. 1 is a plan view of the guide plate portion of my invention.

In FIG. 1, a plan view of my guide plate 10 is shown. In accordance with the invention, a long straight edge 11 is provided which is used to guide the stitching of a straight seam. Edge 14 is used in front of the right toe of a presser foot for stitching along a very narrow edge. I provide convexly curved edge 13 for stitching inside curved edges. Concave edge 15 and short, straight edge 16 are of value in sewing edges of varying widths and directions, and having sharp turns. Sharp corner 12 is adapted to finishing scalloped edges of collars, skirts and the like.

Guide plate 10 may be sized in accordance with the type of work to be guided. However, I have found that dimension A in FIG. 1 may be about 3 inches for general purpose sewing. The thickness of the guide plate may be on the order of 3/16 inch to ¼ inch. In accordance with my invention, the material of guide plate 10 is flexible magnetic rubber, available under the trade name of Koroseal, such as used for refrigerator door locks, magnetic signs for automobiles and the like. This material has very great holding power when placed on a flat steel surface.

Modern sewing machines have smooth, flat bed plates which are generally cast aluminum or a non-magnetic alloy. These machines produce many types of stitches by special cams in the heads. Such stitches required separate attachments on earlier sewing machines. Some present day machines utilize a removable presser foot which may be replaced with an attachment for certain operations. In either case, the tapped hole provided in the bed plate of earlier machines is omitted. Therefore, my invention utilizes a mounting plate 17 shown in plan view in FIG. 2. Although a square mounting plate 17 is illustrated, rectangular or other shapes may be used. I have found that dimension B for a square mounting plate may be 3 to 4 inches for use with a 3 inch guide plate 10 and 26 gauge steel has been found satisfactory. As best seen in FIG. 3, the edges 18 of mounting plate 17 are chamfered or tapered to permit fabric to slide easily over plate 17 without snagging.

Figure 2:
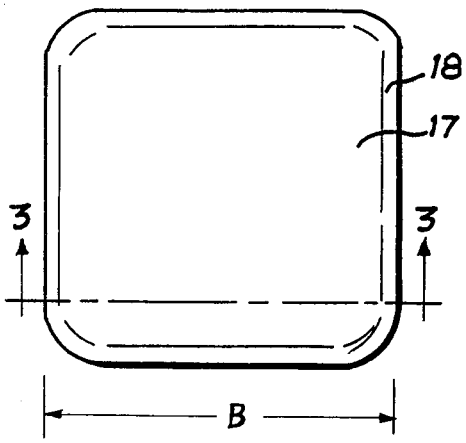
FIG. 2 is a plan view of the mounting plate of my invention.
Figure 3:
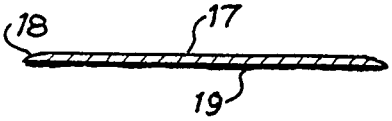
FIG. 3 shows the cross sectional view 3—3 of the mounting plate of FIG. 2.

Turning to FIG. 3, a cross section 3—3 of mounting plate 17 of FIG. 2 is shown. Edges 18 are gradually tapered to present a smooth edge to fabric being sewn. The bottom surface of mounting plate 17 is coated with a pressure type adhesive 19.

Figure 4:
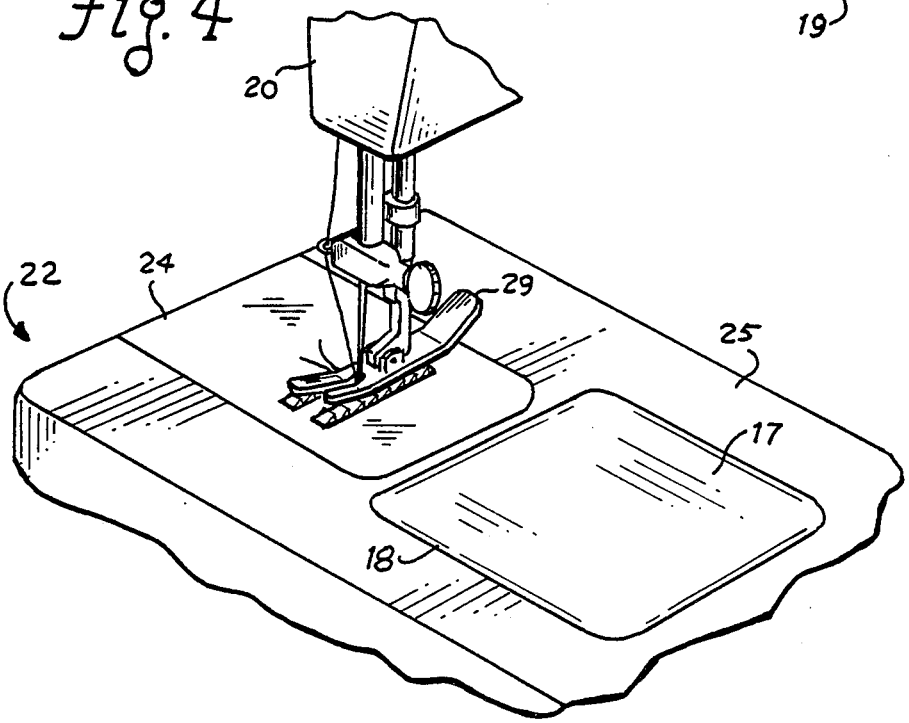
FIG. 4 is a perspective view showing the attachment of the mounting plate to the bed plate of a sewing machine prior to the installation of the guide plate.

A typical installation of mounting plate 17 is shown on sewing machine 22 in FIG. 4. Plate 17 is firmly pressed onto bed plate 25 adjacent needle plate 24. As will be explained below, mounting plate 17 may be mounted to leave a small space between its left edge and needle plate 24. Mounting plate 17 remains in position on bed plate 25 when not using guide plate 10. It is for this reason that edges 18 are tapered since fabrics must be moved across the bed plate 25 smoothly.

Figure 5:
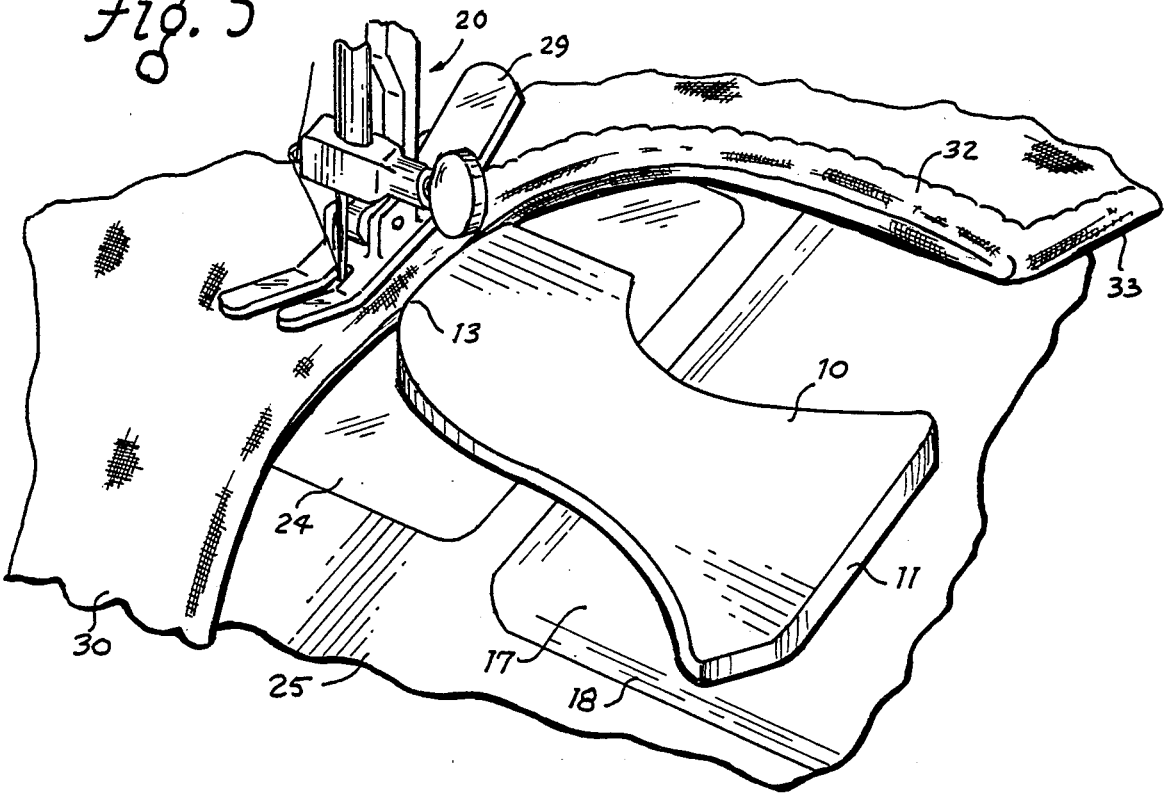
FIG. 5 is a perspective view of the bed plate of a sewing machine with the guide plate installed onto the mounting plate and the needle plate and a curved seam being sewn.

Guide plate 10 is shown in the perspective view of FIG. 5 in place for guiding a curved stitching 32. As will be noted, the magnetic guide plate 10 is held stationary by the magnetic attraction to needle plate 24 and the left hand portion of guide plate 10 and to mounting plate 17 by the right hand portion. A garment 30 is shown in the figure for producing a very even and accurate top stitch which is difficult without the aid of guide plate 10. The operator would first place guide plate 10 with edge 11 adjacent to presser foot 29 and the desired distance from needle for sewing the straight stitch 33. The work is then turned and edge 13 placed in the position shown. It may be noted that the operator can very easily re-adjust the position of guide plate 10 slightly as the sewing progresses and a change in curvature or spacing of the stitch is required.

Figure 6:
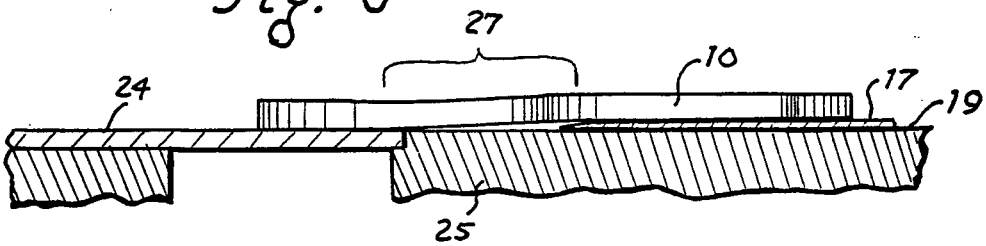
FIG. 6 is a cross sectional view of a sewing machine bed plate and needle plate with the flexible, magnetic guide plate held by both the needle plate and the mounting plate.

FIG. 6 presents a cross sectional view of a typical bed plate 25 and needle plate 24. Mounting plate 17 has been attached to be plate 24 by adhesive 19 with a space between its left edge and needle plate 24. Guide plate 10 has been placed with its right portion on mounting plate 17. The left portion is positioned over needle plate 24. Since the surface of mounting plate 17 is slightly higher than the surface of needle plate 24, the left portion of guide plate 10 is pushed downward until it contacts needle plate 24. Due to the flexibility of the magnetic rubber material, guide plate 10 deforms slightly as indicated by area 27 and is held securely in place by its magnetic attraction to needle plate 24 and mounting plate 17. It also may be noted that guide plate 10 is reversible and may be placed on the mounting plate 17 with either face upward.

Reference is made to my U.S. Pat. No. 3,401,658, FIGS. 3, 4, 5, 6 and 7 and the accompanying discussion for applications of my stitching guide to various types of hems, seams, and stitches.

Although I have described my improved stitching guide with reference to a preferred embodiment, it will be obvious to those of skill in the art to make various modifications without departing from the spirit and scope of my invention.

I claim:

1. A stitching guide adapted to be used with a sewing machine having a steel needle plate and bed plate comprising:

a guide plate fabricated from flexible magnetized rubber-like material, said guide plate having at least one straight edge and one convexly curved edge; and a thin steel mounting plate having a top side and a bottom side, said bottom side having a coating of pressure sensitive adhesive, said mounting plate adapted to be attached by said adhesive to the bed plate of a sewing machine, said guide plate thereby magnetically mountable on said steel plate to place said edges selectively in position to permit guiding of material being stitched.

2. The guide as defined in claim 1 in which the edges of said mounting plate are chamfered to prevent snagging of material being stitched.

3. The guide as defined in claim 1 in which said guide plate has a thickness of about 3/16 inch.

4. The guide as defined in claim 1 in which said guide plate is reversible and is mountable with either face up.

5. The guide as defined in claim 1 in which said guide plate is magnetically mountable on said mounting plate and the steel needle plate of the sewing machine simultaneously, said rubber-like material conformable to a small difference in height between said mounting plate and the needle plate.

6. The guide as defined in claim 1 in which said mounting plate is 26 gauge steel.

* * * * *